US010007200B2

(12) United States Patent
Farrugia et al.

(10) Patent No.: US 10,007,200 B2
(45) Date of Patent: Jun. 26, 2018

(54) ANTIMICROBIAL TONER

(71) Applicant: Xerox Corporation, Norwalk, CT (US)

(72) Inventors: Valerie M Farrugia, Oakville (CA); Alana R Desouza, London (CA); Sandra J Gardner, Oakville (CA); Kimberly D Nosella, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days. days.

(21) Appl. No.: 14/706,037

(22) Filed: May 7, 2015

(65) Prior Publication Data

US 2016/0327879 A1 Nov. 10, 2016

(51) Int. Cl.
*G03G 9/093* (2006.01)
*G03G 9/08* (2006.01)

(52) U.S. Cl.
CPC ..... *G03G 9/0825* (2013.01)

(58) Field of Classification Search
CPC ..... G03G 9/09708; G03G 9/08711
See application file for complete search history.

(56) References Cited

U.S. PATENT DOCUMENTS

| | | | | |
|---|---|---|---|---|
| 6,214,508 | B1 | 4/2001 | Kamada et al. | |
| 2007/0077510 | A1 | 4/2007 | Nosella et al. | |
| 2007/0188275 | A1 | 8/2007 | Wakabayashi et al. | |
| 2007/0207400 | A1* | 9/2007 | Ahuja | G03G 9/0804 430/109.4 |
| 2008/0122881 | A1 | 5/2008 | Iftime et al. | |
| 2009/0047591 | A1 | 2/2009 | McDougall et al. | |
| 2009/0075196 | A1* | 3/2009 | Matsubara | G03G 9/0819 430/110.1 |
| 2011/0062389 | A1 | 3/2011 | Wang et al. | |
| 2012/0128996 | A1 | 5/2012 | Kwon et al. | |
| 2012/0202148 | A1* | 8/2012 | Veregin | G03G 9/093 430/108.1 |
| 2013/0071143 | A1 | 3/2013 | Blanton et al. | |
| 2016/0215104 | A1 | 7/2016 | Farrugia et al. | |

FOREIGN PATENT DOCUMENTS

| | | | | |
|---|---|---|---|---|
| CN | 101812181 A | | 8/2010 | |
| JP | 2003-241423 | * | 8/2003 | G03G 9/08 |

OTHER PUBLICATIONS

Translation of JP 2003-241423 published Aug. 2003.*
Product Data Sheet for NGAP NP Ag-2106-W; https://acs.expoplanner.com/files/acsspring10/ExhibFiles/1037_3483_NANOGAPBROCHURE.pdf.*
Acevedo-Parra et al., "Synthesis . . . Applications," J Macro Sci, Part A, Pure Appl Chem 49, 876-884, 2012.
Norones-Ramirez et al., "Silver . . . Bacteria," Sci Trans Med Jun. 19, 2013; 5(190): 190ra81.doi:10.1126/scutranslmed.300276.
English-language translation of CN 101812181 (9 pages).

* cited by examiner

*Primary Examiner* — Peter L Vajda
(74) *Attorney, Agent, or Firm* — MH2 Technology Law Group LLP

(57) ABSTRACT

Core-shell toner particles with antimicrobial properties are described, the toner particles contain a metal ion nanoparticle in the shell.

20 Claims, No Drawings

ANTIMICROBIAL TONER

FIELD

The disclosure relates to toner particles with a metal ion nanoparticle shell and forming antimicrobial coatings or images therewith on a substrate or forming structures or devices.

BACKGROUND

Noble metal ions, such as, silver and gold ions, are known to be antimicrobial and have been used in medical care to prevent and to treat infection. In recent years, that technology has been applied to consumer products to prevent transmission of infectious disease and to kill harmful bacteria, such as, *Staphylococcus* and *Salmonella*. In common practice, noble metals, metal ions, metal salts or compounds containing metal ions having antimicrobial properties can be applied to surfaces to impart an antimicrobial property to the surface. If, or when, the surface is inoculated with harmful microbes, the antimicrobial metal ions or metal complexes, in effective concentration, slow or prevent growth of those microbes.

In the context of antimicrobial coatings, colloidal silver has been indicated to work as a catalyst disabling a metabolic enzyme of bacteria, fungi and viruses. Many pathogens can be eradicated effectively in presence of even minute traces of silver. Indeed colloidal silver is effective against more than 650 different disease-causing pathogens. Unlike antibiotics, strains resistant to silver have yet to be identified.

There remains a need for printed labels on medical devices and consumer products with an antimicrobial property. Toner is used for printing labels, security marks, clear coats and other applications of 2-dimensional surfaces or structures, and toner-like compositions are used for 3-dimensional applications creating structures and devices.

The use of organic biocide in materials, such as, polymers, inks, toners etc. is known (U.S. Pat. No. 6,210,474) however, those biocide agents do not demonstrate antimicrobial effectiveness within the printed or, "coated," state, such as, in printed ink or toner. Those biocide agents are used generally as a preservative to stabilize material, e.g. polymer, prior to use in preparation of inks and toners, wherein the agent is present in the final ink or toner product in amounts insufficient to impart antimicrobial activity to the printed image made with the ink or toner.

Microorganisms, which include, but are not limited to bacteria, fungi or algae, for example, can be obtained from typical handling of objects, and airborne microbes (sneezing, coughing or other forms of aerosolization) can be spread by vectors, carriers and infected hosts. Hence, images or structures containing antimicrobial toner would be useful in, for example, restaurants (menus), businesses (legal documents) and hospitals (charts, memos, pictures, labels and devices).

Therefore, new antibacterial or antimicrobial toner particles are needed for forming coatings, images, structures or devices wherein contact of microbes with the image, coating, structure or device will inhibit growth and destroy colonization of the microbes.

SUMMARY

The instant disclosure describes toner particles comprising a core and shell, wherein the shell comprises metal ion nanoparticles. In embodiments, the metal ion nanoparticles comprise silver nanoparticles (AgNP's) that impart an antimicrobial property on and to the resulting toner particles as well as after the toner is applied and fused to a substrate or is aggregated to form a structure or device.

In embodiments, core particles are formed and metal ion nanoparticles are added to the core particles wherein the nanoparticles attach to the surface of the core and can encapsulate the core particle. Following shell formation, the particles are coalesced to a desired shape and size to form the toner particles.

In embodiments are provided methods of forming an antimicrobial printed image or an aggregated structure, comprising applying the toner particles comprising silver to a substrate. Substrates include any two-dimensional or three-dimensional surfaces, including, but not limited to, a paper, a plastic, a textile, a platform on which a structure of device is created, a ceramic, a wood, a stone or a rock or a metal, wherein the antimicrobial printed image is affixed to a menu, a medical device, a medical equipment, a food package or packaging, a cosmetic package or packaging, a cosmetic, a food preparation product, a kitchen product, heating or cooling ductwork, a building material, an insulation product, a clean room surface and so on. Accordingly, the antimicrobial printed image may be a printed code, a printed text, a printed logo or forms an antimicrobial coating over an image or a structure. The printed, substrate can be exposed to normal, ambient room conditions without the need for sterility, sterilization or a sterile or sterilized environment.

DETAILED DESCRIPTION

A) Introduction

The present disclosure provides toner particles with antimicrobial properties, even after fused to a surface or a substrate, wherein the toner particles of interest comprise a core and a shell comprising metal ion nanoparticles. In embodiments, the metal ion nanoparticles are silver nanoparticles (AgNP's) which attach to the core surface and can form a shell encapsulating the core particle, either as the sole component of the shell or as a composite, or with other binder and shell components that are not antimicrobial.

Silver nanoparticles (AgNP's) are known for antimicrobial properties, however, the exact mechanism of antimicrobial activity using AgNP's is understood poorly. The AgNP's may interact with the cell wall of the bacteria, consequently destabilizing the plasma membrane potential and reducing levels of intracellular adenosine triphosphate (ATP) resulting in cell death (Mukherjee et al., Theranos 2014; 4(3):316-335). Alternatively, the AgNP's may play a role in formation of reactive oxygen species (ROS) which are responsible for cytotoxicity. Furthermore, AgNP's have been reported to act as a catalyst of chemical reduction-oxidation reactions by facilitating electron transfer between an electron donor and electron acceptor.

In embodiments, the AgNP's may comprise solely elemental silver or may be a silver composite. Composites are useful for imparting additional antimicrobial properties, such as, a silver/copper composite wherein the copper imparts antifungal properties. Other materials can comprise a composite, such as, an anion, a carrier and so on.

Methods for synthesizing metal nanoparticles are known, including composite nanoparticles. No limitation is intended on the method of synthesizing the metal nanoparticles for the preparation of the present toner particles. In embodiments, AgNP's are synthesized by reduction of a source of silver ions, such as, silver nitrate. Silver salts are a common precursor for the synthesis of silver nanoparticles. In that instance, a reducing agent, such as, trisodium citrate dihydrate, is added to a heated solution of a silver salt, such as, silver nitrate, whereby silver nanoparticles are formed.

In embodiments, a method is provided of forming an antibacterial (or antimicrobial) image or structure, where the toner may be printed on any two-dimensional surface or substrate or used to form a three-dimensional structure or device. The antimicrobial printed toner may form a coating over a surface or a substrate or an antimicrobial printed image may form, for example, a printed code, a printed text, a printed image or a printed logo. The antimicrobial printed image may be affixed, for example, to a menu, a label, a medical device, a medical equipment, a food package or packaging, a cosmetic, a cosmetic package or packaging, a drug, a drug packaging, a cosmetic product, a food preparation product, a food, a kitchen product, heating or cooling ductwork, a building material, an insulation product, a clean room surface and so on. In embodiments, the present toner may be used to form codes/labels/logos on a medical device (a catheter or a thermometer, for example), a menu, a label, a food packaging material, a cosmetic, tool etc., or can be used as a clear antimicrobial coat. The surface or substrate may be a platform or surface on which a device of structure is created or in the multiple layers laid down in creating a structure of device, an existing layer on which toner is applied is considered herein as a surface or substrate.

As provided in the Example section, a styrene/acrylate-based toner was made which contained silver nanoparticles in the shell (see Example 2.) That toner had antimicrobial properties when plated on an agar-containing petri dish inoculated with indigenous microbiota of normal bacterial flora of humans (see Example 4.) To mimic the process of toner deposition, the toner was filtered onto various substrates and dried at ambient temperature. To mimic the process of fusing toner to a substrate, dried toner/substrate was laminated. Antimicrobial activity was observed around the print (as seen by a halo devoid of bacterial growth surrounding the toner sample) and on/in the print per se which did not show any evidence of bacterial growth or image degradation (see Example 5.)

B) Definitions

As used herein, the modifier, "about," used in connection with a quantity is inclusive of the stated value and has the meaning dictated by the context (for example, it includes at least the degree of error associated with the measurement of the particular quantity). In embodiments, the terms of interest comprise a variation of less than about 10% from the stated value. When used in the context of a range, the modifier, "about," should also be considered as disclosing the range defined by the absolute values of the two endpoints. For example, the range, "from about 2 to about 4," also discloses the range, "from 2 to 4."

The term, "antibacterial," as used herein refers to the property of a composition for inhibiting or destroying the growth of bacteria. In other words, a toner particle comprising antibacterial properties is effective in killing bacteria, or in inhibiting growth or propagation of bacteria, including as a printed or fused image.

The term, "antimicrobial," as used herein refers to an agent, or the property imparted by the agent, that kills or inhibits growth of microorganisms or microbes. An antibacterial agent, or property thereof, is an antimicrobial agent. Microorganisms include, for example, bacteria, fungi, algae, other single celled organisms, protists, nematodes, parasites, other multicellular organisms, other pathogens and so on. In other words, a toner particle comprising antimicrobial properties is effective in killing microbes, or in inhibiting growth and propagation of microbes, including as a printed and fused image.

The term, "nano," as used in, "silver nanoparticles," indicates a particle size of less than about 1000 nm. In embodiments, the silver nanoparticles have a particle size of from about 0.5 nm to about 1000 nm, from about 1 nm to about 500 nm, from about 1 nm to about 100 nm, from about 1 nm to about 20 nm. Particle size as defined herein can comprise the average diameter of the silver nanoparticles, as determined, for example, by transmission electron microscopy (TEM).

A polymer can be identified or named herein by the one or more of the constituent monomers used to construct the polymer, even though following polymerization, a monomer can be altered and no longer is identical to the original reactant. Thus, for example, a polyester often is composed of a polyacid monomer or component and a polyalcohol monomer or component. Accordingly, if a trimellitic acid reactant is used to make a polyester polymer, that resulting polyester polymer can be identified herein as a trimellitic polyester.

By, "two dimension," or grammatic forms thereof, such as, 2-D, is meant to relate to a structure or surface that is substantially without measureable or discernible depth, without use of a mechanical measuring device. Generally, the surface is identified as flat, and emphasizes height and width, and lacks the illusion of depth or thickness. Thus, for example, toner is applied to a surface to form an image or coating and generally, that layer of fused toner is from about 1 μm to about 10 μm in thickness. Nevertheless, that application of toner to a flat surface is considered herein as a two dimensional application. The surface can be a sheet or a paper, for example. This definition is not meant to be a mathematic or scientific definition at the molecular level but one which to the eye of the viewer or observer, there is no illusion of thickness. A thicker layer of toner, such as one which might be identified as providing, "raised lettering," on a surface is for the purposes herein, included in the definition of 2-D.

By, "three dimension," or grammatic forms thereof, such, as, 3-D, is meant to relate to a structure composed of plural layers or particle depositions of toner that aggregate or assemble to yield a form, a shape, a construct, an object and the like that, for example, need not be applied to a surface or structure, can be autonomous and/or has a thickness or depth. Printing as used herein includes producing 3-D structures. Printing on a surface or structure also is used herein to include forming a 3-D structure by deposition of plural layers of toner. Often, the first layer is printed on a support, surface, substrate or structure. Successive layers of toner are placed thereon and the already deposited (and optionally adhered or solidified) toner layer or layers is considered herein a surface or a substrate.

C) Toner Particles

The toner particles of interest comprise a core and a shell comprising metal ion nanoparticles, such as, silver nanoparticles.

a) Resins and Latexes

Any monomer suitable for preparing a latex for use in a toner may be utilized. Such latexes may be produced by conventional methods.

Suitable monomers include, but are not limited to, styrenes, acrylates, methacrylates, butadienes, isoprenes, acrylic acids, methacrylic acids, acrylonitriles, combinations thereof and the like. Exemplary monomers include, but are not limited to styrene, alkyl acrylate, such as, methyl acrylate, ethyl acrylate, butyl acrylate, isobutyl acrylate, dodecyl acrylate, n-octyl acrylate, 2-chloroethyl acrylate; β-carboxy ethyl acrylate (β-CEA), phenyl acrylate, methyl α-chloroacrylate, methyl methacrylate (MMA), ethyl methacrylate and butyl methacrylate; butadiene; isoprene; methacrylonitrile; acrylonitrile; vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone and methyl isopropenyl ketone; vinylidene halides, such as, vinylidene chloride and vinylidene chlorofluoride; N-vinyl indole; N-vinyl pyrrolidone; methacrylate (MA); acrylic acid; methacrylic acid; acrylamide; methacrylamide; vinylpyridine; vinylpyrrolidone; vinyl-N-methylpyridinium chloride; vinyl naphthalene; p-chlorostyrene; vinyl chloride; vinyl bromide; vinyl fluoride; ethylene; propylene; butylenes; isobutylene; and the like, and mixtures thereof.

Exemplary styrene/acrylate polymers include styrene acrylates styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly (alkyl methacrylate-alkyl acrylate), poly(alkyl methacrylate-aryl acrylate), poly(aryl methacrylate-alkyl acrylate), poly (alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly (ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid) and combinations thereof. The polymer may be a block, random or alternating copolymer.

Other illustrative examples of a styrene/acrylate latex copolymer includes poly(styrene-n-butyl acrylate-β-CEA), poly(alkyl methacrylate), poly(styrene-alkyl acrylate-acrylonitrile), poly(styrene-1,3-diene-acrylonitrile), poly(alkyl acrylate-acrylonitrile), poly(styrene-butadiene-acrylonitrile), poly(styrene-butyl acrylate-acrylonitrile) and the like.

Based on total weight of the monomers, styrene may be present in an amount from about 01% to about 99%, from about 50% to about 95%, from about 70% to about 90%, although may be present in greater or lesser amounts. Acrylate(s) may be present in an amount from about 01% to about 99%, from about 05% to about 50%, from about 10% to about 30%, although may be present in greater or lesser amounts.

The styrene/acrylate resin particle can have a size from about 155 nm to about 215 nm, from about 165 nm to about 205 nm, from about 175 nm to about 195 nm. The styrene/acrylate resin particle can have a molecular weight from about 20,000 (20 k) to about 50 k, from about 25 k to about 45 k, from about 30 k to about 40 k.

In embodiments, the core particles may include a styrene or acrylate resin, a polyester resin or combination thereof and so on. Any polyester resin can be used, including the resins described in U.S. Pat. Nos. 6,593,049 and 6,756,176, the entire disclosure of each of which herein is incorporated by reference in entirety. The polyesters may be amorphous, crystalline or both. Suitable amorphous resins include those disclosed in U.S. Pat. No. 6,063,827, the entire disclosure of which herein is incorporated by reference in entirety. Suitable crystalline resins include those disclosed in U.S. Publ. No. 2006/0222991, the entire disclosure of which herein is incorporated by reference in entirety. Suitable polyester latexes also may include a mixture of an amorphous polyester resin and a crystalline polyester resin as described in U.S. Pat. No. 6,830,860, the entire disclosure of which herein is incorporated by reference in entirety.

In embodiments, an unsaturated polyester resin may be utilized as a polyester latex resin. Examples of such resins include those disclosed in U.S. Pat. No. 6,063,827, the entire disclosure of which herein is incorporated by reference in entirety. Exemplary unsaturated polyester resins include, but are not limited to, poly(1,2-propylene fumarate), poly(1,2-propylene maleate), poly(1,2-propylene itaconate) and so on, and combinations thereof.

In what follows, an, "acid-derived component," or functional variations thereof indicates a constituent moiety or monomer that was originally an acid component before incorporation into through synthesis of a polyester polymer and an, "alcohol-derived component," or functional variations thereof indicates a constituent moiety or monomer that was originally an alcoholic component before incorporation into through synthesis of the polyester polymer resin. The acid component can be a polyacid. The alcohol component can be a polyol.

The polyester polymer can be formed by reacting a polyol with a polyacid in the presence of an optional catalyst. Polycondensation catalysts which may be utilized in forming either the crystalline or amorphous polyesters include tetraalkyl titanates, dialkyltin oxides, such as, dibutyltin oxide; tetraalkyltins, such as, dibutyltin dilaurate; dialkyltin oxide hydroxides, such as, butyltin oxide hydroxide, aluminum alkoxides, alkyl zinc, dialkyl zinc, zinc oxide, stannous oxide or combinations thereof. Such catalysts may be utilized in amounts of, for example, from about 0.01 mole % to about 5 mole % based on the starting polyacid or polyester used to generate the polyester resin.

A, "crystalline polyester resin," is one that shows not a stepwise endothermic amount variation but a clear endothermic peak in differential scanning calorimetry (DSC). However, a polymer obtained by copolymerizing, the crystalline polyester main chain and at least one other component also is called a crystalline polyester if the amount of the other component is 50% by weight or less.

Monomer polyacids having 6 to 10 carbon atoms may be desirable for obtaining suitable crystal melting point and charging properties. To improve crystallinity, a straight chain polycarboxylic acid may be present in an amount of about 95% by mole or more of the acid component, more than about 98% by mole of the acid component. Other polyacids are not particularly restricted and examples thereof include conventionally known polycarboxylic acids and polyhydric alcohols, for example, those described in, "Polymer Data Handbook: Basic Edition," (Soc. Polymer Science, Japan Ed.: Baihukan). As the alcohol component, aliphatic polyalcohols having from about 6 to about 10 carbon atoms may be used to obtain desirable crystal melting points and charging properties. To raise crystallinity, it may be useful to use the straight chain polyalcohols in an amount of about 95% by mole or more, about 98% by mole or more.

For forming a crystalline polyester, suitable polyols include aliphatic polyols with from about 2 to about 36 carbon atoms, such as, 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; mixture thereof, and the like. The aliphatic polyol may be, for example, selected in an amount of from about 40 to about 60 mole %, from about 42 to about 55 mole %, from about 45 to about 53 mole % (although amounts outside of those ranges can be used).

Examples of polyacids or polyesters including vinyl polyacids or vinyl polyesters, selected for the preparation of a crystalline resin include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; or mixtures thereof. The polyacid may be selected in an amount of from about 40 to about 60 mole %.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), polybutylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), poly(octylene-adipate), wherein alkali is a metal, such as, sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), polyethylene-succinimide), poly(propylene-succinimide), and poly(butylene-succinimide).

The crystalline resin may be present, for example, in an amount of from about 4 to about 14% by weight of the toner components, from about 5 to about 12%, from about 6 to about 10% by weight of the toner resins. The crystalline resin can possess various melting points of, for example, from about 30° C. to about 120° C., from about 50° C. to about 90° C. The crystalline resin may have a weight average molecular weight ($M_w$), as measured by gel permeation chromatography (GPC) of, for example, from about 15,000 to about 30,000, from about 20,000 to about 25,000. The molecular weight distribution ($M_w/M_n$) of the crystalline resin may be, for example, from about 2 to about 6, from about 3 to about 5. The crystalline resin particles can be from about 170 to about 230 nm in size, from about 180 to about 220 nm, from about 190 to about 210 nm in size.

Examples of polyacids or polyesters including vinyl polyacids or vinyl polyesters utilized for the preparation of amorphous polyesters include polycarboxylic acids or polyesters, such as, terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmalate, dimethylglutarate, dimethyladipate, dimethyl dodecylsuccinate, and combinations thereof. The polyacid or polyester may be present, for example, in an amount from about 40 to about 60 mole % of the resin, from about 42 to about 52 mole % of the resin, from about 45 to about 50 mole % of the resin.

Examples of polyols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, 1,4-cyclohexanedimethanol, 1,3-cyclohexanedimethanol, xylenedimethanol, cyclohexanediol, diethylene glycol, dipropylene glycol, dibutylene, and combinations thereof. The amount of polyol selected can vary, and may be present, for example, in an amount from about 40 to about 60 mole % of the resin, from about 42 to about 55 mole % of the resin.

A high molecular weight (HMW) amorphous resin can have a molecular weight from about 70 k to about 84 k, from about 72 k to about 82 k, from about 74 k to about 80 k. A low molecular weight (LMW) amorphous resin can have a molecular weight from about 12 k to about 24 k, from about 14 k to about 22 k, from about 16 k to about 20 k.

The amorphous resin particles can be from about 170 to about 230 nm, from about 180 to about 220 nm, from about 190 to about 210 nm in size.

The polyester resins may be synthesized from a combination of components selected from the above-mentioned monomer components, using conventional known methods. Exemplary methods include the ester exchange method and the direct polycondensation method, which may be used singularly or in a combination thereof. The molar ratio (acid/alcohol) when the acid component and alcohol component are reacted, may vary depending on the reaction conditions. The molar ratio can be about 1/1 in direct polycondensation. In the ester exchange method, a monomer, such as, ethylene glycol, neopentyl glycol or cyclohexanedimethanol, which may be distilled away under vacuum, may be used in excess.

i) Surfactants

Any suitable surfactant may be used for the preparation of a latex, pigment or wax dispersion according to the present disclosure. Depending on the emulsion system, any desired nonionic or ionic surfactant, such as, anionic or cationic surfactant, may be contemplated.

Examples of suitable anionic surfactants include, but are not limited to, sodium dodecylsulfate (SDS), sodium dodecylbenzene sulfonate, sodium dodecylnaphthalenesulfate, dialkyl benzenealkyl sulfates and sulfonates, abitic acid, NEOGEN R® and NEOGEN SC® available from Kao, Tayca Power®, available from Tayca Corp., DOWFAX®, available from Dow Chemical Co., and the like, as well as mixtures thereof.

Examples of suitable cationic surfactants include, but are not limited to, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$,$C_{15}$,$C_{17}$-trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals), and the like, as well as mixtures thereof.

Examples of suitable nonionic surfactants include, but are not limited to, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from sanofi as ANTAROX 890®, IGEPAL CA-210®, IGEPAL CA-520®, IGEPAL CA-720®, IGEPAL CO-890®, IGEPAL CO-720®, IGEPAL CO-290®, IGEPAL CA-210® and ANTAROX 897®) and the like, as well as mixtures thereof.

Surfactants may be employed in any desired or effective amount, for example, at least about 0.01% by weight of the reactants, at least about 0.1% by weight of the reactants; no more than about 10% by weight of the reactants, no more than about 5% by weight of the reactants, although the amount can be outside of those ranges.

ii) Initiator

A suitable initiator or mixture of initiators may be used in the latex process and the toner process. In embodiments, the initiator is selected from known free radical polymerization initiators. Examples of suitable free radical initiators include, but are not limited to, peroxides, pertriphenylacetate, tert-butyl performate, sodium persulfate, azo compounds and the like.

Based on total weight of the monomers to be polymerized, the initiator may be present in an amount from about 0.1 to about 5%, from about 0.4% to about 4%, from about 0.5% to about 3%, although may be present in greater or lesser amounts.

iii) Chain Transfer Agent

A chain transfer agent optionally may be used to control the polymerization degree of the latex, and thereby to control the molecular weight and molecular weight distribution of the product latex. As can be appreciated, a chain transfer agent can become part of the latex polymer.

A chain transfer agent can have a carbon-sulfur covalent bond. Exemplary chain transfer agents include, but are not limited to, n-$C_{3-15}$ alkylmercaptans; branched alkylmercaptans; aromatic ring-containing mercaptans; and so on. Examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like. The terms, "mercaptan," and, "thiol," may be used interchangeably to mean a C—SH group.

Based on total weight of the monomers to be polymerized, the chain transfer agent may be present in an amount from about 0.1% to about 7%, from about 0.5% to about 6%, from about 1.0% to about 5%, although may be present in greater or lesser amounts.

iv) Branching Agent

In embodiments, a branching agent optionally may be included to control the branching degree, crosslinking degree and/or structure of the target latex. Exemplary branching agents include, but are not limited to, decanediol diacrylate (ADOD), trimethylolpropane, pentaerythritol, trimellitic acid, pyromellitic acid and mixtures thereof.

Based on total weight of the monomers to be polymerized, the branching agent may be present in an amount from about 0.001% to about 2%, from about 0.05% to about 1.0%, from about 0.1% to about 0.8%, although may be present in greater or lesser amounts.

v) Method

In the latex process and toner process of the disclosure, emulsification may be done by any suitable process, such as, mixing, optionally, at elevated temperature. For example, the emulsion mixture may be mixed in a homogenizer set at about 200 to about 400 rpm and at a temperature of from about 20° C. to about 80° C. for a period of from about 1 min to about 20 min, although speed, temperature and time outside of those ranges can be used.

Any type of reactor may be used without restriction. The reactor can include means for stirring the compositions therein, such as, an impeller. A reactor can include at least one impeller. For forming the latex and/or toner, the reactor can be operated such that the impeller(s) operate at an effective mixing rate of about 10 to about 1,000 rpm.

Following completion of monomer addition, the latex may be permitted to stabilize by maintaining the conditions for a period of time, for example for about 10 to about 300 min, before cooling. Optionally, the latex formed by the above process may be isolated by standard methods known in the art, for example, coagulation, dissolution, precipitation, filtering, washing, drying or the like.

A latex of the present disclosure may be melt blended or otherwise mixed with various toner ingredients, such as, an optional wax dispersion, an optional colorant, an optional coagulant, an optional silica, an optional charge enhancing additive or charge control additive, an optional surfactant, an optional emulsifier, an optional flow additive and the like. Optionally, the latex (e.g. around 40% solids) may be diluted to the desired solids loading (e.g. about 12 to about 15% by weight solids), before formulated into a toner.

Based on the total toner weight, a latex may be present in an amount from about 50% to about 98%, although may be present in lesser amounts. Methods of producing such latex resins may be carried out as described in U.S. Pat. No. 7,524,602, the entire content of which herein is incorporated by reference in entirety.

b) Optional Colorants

In embodiments, the toner particles optionally may comprise one or more colorants. In embodiments, the toner particles may be colorless or clear. Various known suitable colorants, such as dyes, pigments, mixtures of dyes, mixtures of pigments, mixtures of dyes and pigments and the like may be included in the toner. The colorant may be included in the toner in an amount of for example, 0 to about 35% by weight of the toner, from about 1 to about 25% of the toner, from about 3 to about 20% by weight of the toner, although amounts outside those ranges may be utilized.

As examples of suitable colorants, mention may be made of carbon black like REGAL 330®; magnetites, such as Mobay magnetites MO8029™ and MO8060™; Columbian magnetites; MAPICO BLACKS™, surface-treated magnetites; Pfizer magnetites CB4799™, CB5300™, CB5600™ and MCX6369™; Bayer magnetites, BAYFERROX 8600™ and 8610™; Northern Pigments magnetites, NP-604™ and NP-608™; Magnox magnetites TMB-100™ or TMB-104™; and the like. As colored pigments, there can be selected cyan, magenta, yellow, red, green, brown, blue or mixtures thereof. Generally, cyan, magenta or yellow pigments or dyes, or mixtures thereof, are used. The pigment or pigments can be water-based pigment dispersions.

Specific examples of pigments include SUNSPERSE 6000, FLEXIVERSE and AQUATONE water-based pigment dispersions from SUN Chemicals, HELIOGEN BLUE L6900™, D6840™, D7080™, D7020™, PYLAM OIL BLUE™, PYLAM OIL YELLOW™, PIGMENT BLUE I™ available from Paul Uhlich & Company, Inc., PIGMENT VIOLET I™, PIGMENT RED 48™, LEMON CHROME YELLOW DCC 1026™, E.D. TOLUIDINE RED™ and BON RED C™ available from Dominion Color Corp., Ltd., Toronto, CA, NOVAPERM YELLOW FGL™, HOSTAPERM PINK E™ from sanofi, CINQUASIA MAGENTA™ available from E.I. DuPont de Nemours & Co. and the like. Colorants that can be selected are black, cyan, magenta, yellow and mixtures thereof. Examples of magenta colorants are 2,9-dimethyl-substituted quinacridone and anthraquinone dye identified in the Color Index (CI) as CI 60710, CI Dispersed Red 15, diazo dye identified in the Color Index as CI 26050, CI Solvent Red 19 and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, Anthrathrene Blue, identified in the Color Index as CI 69810, Special Blue X-2137 and the like. Examples of yellows are diarylide yellow 3,3-dichlorobenzidene acetoacetanilides, a monoazo pigment identified. In the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL. Colored magnetites, such as, mixtures of MAPICO BLACK™, and cyan components also may be selected as colorants. Other known colorants can be selected, such as, Levanyl Black A-SF (Miles, Bayer) and Sunsperse Carbon Black LHD 9303 (Sun Chemicals), and colored dyes, such as Neopen Blue (BASF), Sudan Blue OS (BASF), PV Fast Blue B2G01 (sanofi), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (sanofi), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (sanofi), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann, CA), E.D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like.

c) Optional Wax

A toner of the present disclosure optionally may contain a wax, which can be either a single type of wax or a mixture of two or more different waxes. When included, the wax may be present in an amount of, for example, from about 1 wt % to about 25 wt % of the toner particles, from about 5 wt % to about 20 wt % of the toner particles. The melting point of a wax can be at least about 60° C., at least about 70° C., at least about 80° C. Waxes that may be selected include waxes having, for example, a weight average molecular weight of from about 500 to about 20,000, from about 1,000 to about 10,000. Wax particles can be from about 125 nm to about 250 nm, from about 150 to about 225 nm, from about 175 to about 200 nm in size.

Waxes that may be used include, for example, polyolefins, such as, polyethylene, polypropylene and polybutene waxes, such as, commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K.K.; plant-based waxes, such as, carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate, pentaerythritol tetra behenate; ester waxes obtained from higher fatty acid and multivalent alcohol multimers, such as, diethyleneglycol monostearate, dipropyleneglycol distearate, diglyceryl distearate and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example, AQUA SUPERSLIP 6550™ SUPERSLIP 6530™ available from Micro Powder Inc., fluorinated waxes, for example, POLYFLUO 190™, POLYFLUO 200™, POLYSILK 19™ and POLYSILK 14™ available from Micro Powder Inc., mixed fluorinated, amide waxes, for example, MICROSPERSION 19™ available from Micro Powder Inc., imides, esters, quaternary amines, carboxylic acids or acrylic polymer emulsion, for example JONCRYL 74™, 89™, 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes also may be used in embodiments.

d) Shell

The toner particles of the present disclosure comprise a shell surrounding aggregated core particles, wherein the shell comprises metal (I) ions. Silver metal ions are known to possess antimicrobial properties and may be referred to as an antimicrobial metal ion. Suitable antimicrobial metals and metal ions include, but are not limited to, silver, copper, zinc, gold, mercury, tin, lead, iron, cobalt, nickel, manganese, arsenic, antimony, bismuth, barium, cadmium, chromium and thallium. Metal ions of silver, copper, zinc and gold or combinations thereof, for example, are considered safe for human contact. Hence, silver ions, alone or in combination with copper or zinc or both, for example, have a high ratio of efficacy to toxicity, i.e., high efficacy to low toxicity.

For example, a combination of silver and copper ions provides both an antibacterial property of silver ions and an antifungal property of copper ions. Thus, one is able to tailor the toner particles by selection of specific metal ions and combinations thereof incorporated into the shell surrounding, the core particles of the toner for particular end-use applications.

The shell comprises a metal ion, such as, AgNP's. In embodiments, the shell further comprises a styrene/acrylate resin and/or a polyester resin. In embodiments, a shell can include reagents that are not antimicrobial, such as, a resin, a conductive material, such as, a colorant and so on, as known in the art. A shell can cover all of or a portion of the exterior surface of a core toner particle.

The particle size of the metal nanoparticles is determined by the average diameter of the particles. The metal nanoparticles may have an average diameter of about 100 nm or less, 20 nm or less. In embodiments, the metal nanoparticles have an average diameter of from about nm to about 15 nm, from about 3 nm to about 10 nm. In embodiments, metal nanoparticles may have a uniform particle size with a narrow particle size distribution. The particle size distribution can be quantified using the standard deviation of the average particle size of a population. In embodiments, the metal nanoparticles have a narrow particle size distribution with an average particle size standard deviation of about 3 nm or less, about 2.5 nm or less. In embodiments, the metal nanoparticles have an average particle size of from about 1 nm to about 10 nm with a standard deviation of from about 1 nm to about 3 nm. Without being limited by theory, it is believed that small particle size with a narrow particle size distribution enable the metal nanoparticles to disperse easier when placed in a solvent, and can offer a more uniform coating of or on a core toner particle.

In embodiments, the metal nanoparticles have a particle size in a range from about 2 nm to about 50 nm, from about 10 nm to about 50 nm, from about 20 nm to about 50 nm.

In embodiments, the metal nanoparticles may comprise solely elemental silver or may be a silver composite, including composites with other metals. Such silver composites may include either or both of (i) one or more other metals and (ii) one or more non-metals. Suitable other metals include, for example Al, Au, Pt, Pd, Cu, Co, Cr, In and Ni, such as, the transition metals, for example, Au, Pt, Pd, Cu, Cr, Ni and mixtures thereof. Exemplary metal composites are Au—Ag, Ag—Cu, Au—Ag—Cu and Au—Ag—Pd. Suitable non-metals in the silver composite include, for example, Si, C and Ge. The various non-silver components of the silver composite may be present in an amount ranging, for example, from about 0.01% to about 99.9% by weight, from about 10% to about 90% by weight. In embodiments, the silver composite is a metal alloy composed of silver and one, two or more other metals, with silver comprising, for example, at least about 20% of the nanoparticle by weight, greater than about 50% of the nanoparticle by weight. Unless otherwise noted, the weight percentages recited herein for the components of the silver-containing nanoparticles do not include a stabilizer.

Silver nanoparticles composed of a silver composite can be made, for example, by using a mixture of: (i) a silver compound (or compounds, such as, a silver (I) ion-containing compound); and (ii) another metal salt (or salts) or another non-metal (or non-metals) during a reduction step.

Those skilled in the art will appreciate that metals other than silver may be useful and can be prepared in accordance with the methods disclosed herein. Thus, for example, composites may be prepared with nanoparticles of copper, gold, palladium or composites of such exemplary metals.

In embodiments, the composites may comprise further nanostructured materials, such as, without limitation, a carbon nanotube (CNT, including single-walled, double-walled, and multi-walled), a graphene sheet, a nanoribbon, a nano-onion, a hollow nanoshell metal, a nanowire and the like. In embodiments. CNT's may be added in amounts that enhance electrical and thermal conductivity.

In embodiments are provided methods for preparing silver nanoparticles comprising heating a solution of silver ions in water to form a mixture and adding a solution of a reducing agent to the mixture, thereby forming an emulsion of silver nanoparticles. In embodiments, heating includes boiling the mixture.

A source of silver (I) ion can be selected from silver nitrate, silver sulfonate, silver fluoride, silver perchlorate, silver lactate, silver tetrafluoroborate, silver oxide or silver acetate.

In embodiments, the source of silver (I) ion is a silver salt selected from silver acetylacetonate, silver benzoate, silver bromate, silver bromide, silver carbonate, silver chloride, silver citrate, silver iodate, silver iodide, silver nitrite, silver phosphate, silver sulfate, silver sulfide or silver trifluoroacetate. The silver salt particles can be fine for homogeneous dispersion in the water solution, which aids reaction.

In embodiments, the reducing agent is selected from ascorbic acid, trisodium citrate, glucose, galactose, maltose, lactose, gallic acid, rosmaric acid, caffeic acid, tannic acid, dihydrocaffeic acid, quercetin, potassium borohydride, hydrazine hydrate, sodium hypophosphite or hydroxylamine hydrochloride. In embodiments, a reducing agent for the synthesis of a metal nanoparticle may include sodium borohydride or sodium citrate. Selection of an appropriate reducing agent may provide access to desirable nanoparticle morphologies.

In embodiments, the total metal present in the toner is from about 12,000 to 15,000 ppm, from about 12,000 to 14,000 ppm, from about 12,000 to about 13,000 ppm, as measured by inductively coupled plasma (ICP) mass spectrometry (MS). In embodiments, the total metal present in the toner is from about 1.2% to 1.5%, from about 1.2 to 1.4%, from about 1.2% to about 1.3% by weight of the toner, as measured by ICP-MS.

e) Toner Preparation

Toner particles may be prepared by any method within the purview of one skilled in the art. Although embodiments relating to toner particle production are described below with respect to emulsion aggregation (EA) processes, any suitable method of preparing toner particles may be used, including chemical processes, such as, suspension and encapsulation processes disclosed in U.S. Pat. Nos. 5,290, 654 and 5,302,486, the entire disclosure of each of which herein is incorporated by reference in entirety.

Toner compositions may be prepared by EA processes, such as, a process that includes aggregating a mixture of at least one styrene/acrylate resin, an optional polyester resin, an optional wax, an optional colorant and any other desired or required reagents, optionally with surfactants, as described above, to form a mixture in a reactor. The pH of the resulting mixture may be adjusted by an acid, such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute (rpm). Homogenization may be accomplished by any suitable means, including, for example, with an IKA ULTRA TURRAX T50 probe homogenizer.

Resin particles can have a size from about 100 nm to about 250 nm, from about 120 nm to about 230 nm, from about 130 nm to about 220 nm, although the particle size can be outside of those ranges. The resin particles then are combined with any optional wax, any optional colorant and other toner reagents as a design choice to form core particles.

Following preparation of a mixture to form toner, an aggregating agent (or coagulant or flocculent) can be added to the mixture to form aggregated core particles. Suitable aggregating agents include, for example, aqueous solutions of a divalent cation or a multivalent cation material known to aggregate certain resins to form larger resin aggregates which can be used to form toner, such as, agents for flocculating polyester resins and agents for coagulating styrene/acrylate resins. The aggregating agent may be, for example, polyaluminum halides, such as, polyaluminum chloride (PAC), or the corresponding bromide, fluoride or iodide, polyaluminum silicates, such as, polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate and combinations thereof. In embodiments, the aggregating agent may be added to the mixture at a temperature that is below the glass transition temperature ($T_g$) of the resin.

The aggregating agent may be added to the mixture to form a toner in an amount of, for example, from about 0.1 parts per hundred (pph) to about 5 pph, from about 0.25 pph to about 4 pph.

To control aggregation of the particles, the aggregating agent may be metered into the mixture over time. For example, the agent may be metered into the mixture over a period of from about 5 to about 240 min. Addition of the agent also may be done while the mixture is maintained, under stirred conditions, in embodiments, from about 50 rpm to about 1,000 rpm, and at a temperature that is below the $T_g$ of the resin.

Aggregation thus may proceed by maintaining the elevated temperature, or slowly raising the temperature to, for example, from about 400° C. to about 100° C., and holding the mixture at that temperature for a time from about 0.5 hr to about 6 hr, while maintaining stirring, to provide the core particles.

The core particles may be permitted to aggregate until a predetermined desired particle size is obtained. Particle size can be monitored as known in the art, for example, with a COULTER COUNTER, for average particle size. In embodiments, the particle size may be from about 4 to about 7 μm.

Once the desired final size of the toner particles is achieved, the pH of the mixture may be adjusted with a base or a buffer to a value of from about 6 to about 10, from about 5 to about 8. The adjustment of the pH freezes, that is, stops, toner particle growth. The base utilized to stop toner particle growth may be any suitable base, such as, for example, alkali metal hydroxides, such as, for example, sodium hydroxide, potassium hydroxide, ammonium hydroxide, combinations thereof and the like. In embodiments, an agent, such as, ethylenediamine tetraacetic acid (EDTA) or equivalent functional compounds may be added to adjust to the desired value noted above.

The gloss of a toner may be influenced by the amount of retained metal ion, such as. $Al^{3+}$, in the particle. In embodiments, the amount of retained metal ion, for example, $Al^{3+}$, in toner particles of the present disclosure may be from about 0.001 pph to about 1 pph, from about 0.003 pph to about 0.3 pph.

e) Shell

In embodiments, a shell containing metal ion nanoparticles is applied to the formed core particles. In embodiments, metal nanoparticles are added to the aggregated core particle slurry to form a shell which can encapsulate the core particles. The slurry then is heated until a desired particle size is achieved. The shell can contain only metal ion nanoparticles, although shell components not antimicrobial known in the art, such as, a resin or a conductive agent, can be included in a shell of interest.

Hence, the shell optionally may comprise any one or more amorphous resins described above or as known in the art. The shell may comprise a conductive material, such as, a colorant, such as, a black colorant. The shell resin may be applied to the particles by any method within the purview of those skilled in the art. The aggregated particles described above are combined with said emulsion so that the materials form a shell over the core particles.

The shell material attaches to the surface of a core particle. The shell material may cover the entire surface of a core particle or portions thereof. Hence, the shell can encapsulate a core particle or be found, for example, at sites on the surface of a core, as isolated patches of varying size, islands and so on.

In embodiments, a photoinitiator, a branching agent and the like may be included in the resin-containing mixture for forming the shell. In embodiments, the shell resin may be in an emulsion including any surfactant described herein. In embodiments, the optional resin component present in the shell may comprise about 20 to about 40% by weight of the toner particles, from about 22 to about 36%, from about 24 to about 32% by weight of the toner particles Toner particles comprising a shell can have a diameter of from about 4 to about 8 μm, from about 5 to about 7 μm.

f) Coalescence

The core-shell particles then can be coalesced to the desired final shape, the coalescence being achieved by, for example, heating the mixture to a temperature of from about 55° C. to about 100° C. Higher or lower temperatures may be used, it being understood that the temperature is a function of the resins used.

Coalescence may proceed over a period of from about 1 min to about 9 hr, although times outside of that range can apply, for example, depending whether coalescence occurs in a batch reactor or in a microreactor.

In a continuous system or reactor, or a microreactor, reduced volumes of reagents are coursed in a unidirectional manner through the reactor. For example, aggregated particles and reactants, often in a slurry, from a batch or a continuous reactor are fed continuously, discontinuously or metered at controllable rates and in controllable amounts by communicating devices, such as, lines, conduits, tubing and so on, composed of suitable materials, to and for incubation to the continuous reactor. The communicating devices can comprise and the continuous reactor comprises one or more devices for controlling temperature of the contents therein, such as, a heating, or a cooling element. The heating and cooling elements can be positioned along the communication devices and along the flow path of the continuous reactor to provide a controlled or particular temperature profile for the communicated reactants within the communication device and the reactor or reactor unit and the aggregated particle slurry in the continuous reactor. A pump or urging device can cause movement of the slurry from a batch reactor to and through a continuous reactor. The continuous reactor can comprise other fluid or slurry urging devices to maintain a desired flow rate therethrough.

The continuous reactor can comprise a series of tubes, channels, voids, tubular voids, voids within partially flattened or ovoid tubes and the like, any suitable flow path, wherein plural such continuous reactors can be connected in parallel, for example via a manifold, to provide a plurality of a continuous directed flow path, each through each of a plurality of devices that comprise a reactor. The temperature regulating devices, such as, a heating or a cooling element, can comprise a liquid, such as, an oil or a water, that bathes a directed parallel flow path to provide an appropriate temperature or temperature profile along a the flow path under which a reaction occurs. The flow path can be connected to an egress device by a communication device, such as, a line, conduit, tubing and the like to course the reacted mixture to a product receiving vessel. The reaction apparatus can be operated under pressure to reduce reagent and fluid boiling points and to ensure unimpeded or continuous movement and uniform flow of the reaction mixture through the reactor.

In embodiments, a continuous reactor of interest comprises a plurality of units comprising, for example, about four regions, flow paths, fluid flow paths, zones, subparts, sections and the like, where each region, zone and the like provides a different environment or different conditions for the slurry contained therein, such as, one region provides a ramping of conditions for coalescence and another subsequent zone can be one where coalescence of particles occurs. In embodiments, the reactor comprises multiple units, parts, components and the like that are operably connected to provide a continuous flow path, where each unit provides a different environment for the contained slurry, and which is where a separate process of toner development occurs.

After coalescence, the mixture may be cooled to room temperature (RT), such as, from about 20° C. to about 25° C. The cooling may be rapid or slow, as desired. A suitable cooling method may include introducing cold water to a jacket around a reactor or reactor part. After cooling, the toner particles optionally may be washed with water and then dried. Drying may be accomplished by any suitable method, for example, freeze drying.

g) Additives

Toner particles also may contain optional additives, as desired or required. For example, the toner may include any known charge additives in amounts of from about 0.1 to about 10 wt %, from about 0.5 to about 7 wt % of the toner. Examples of such charge additives include alkyl pyridinium halides, bisulfates, the charge control additives of U.S. Pat. Nos. 3,944,493, 4,007,293, 4,079,014, 4,394,430 and 4,560,635, the entire disclosure of each of which herein is incorporated by reference in entirety, negative charge enhancing additives, such as, aluminum complexes, and the like.

Surface additives can be added to the toner compositions after washing or drying. Other examples of such surface additives include, for example, metal salts, metal salts of fatty acids, colloidal silicas, metal oxides, strontium titanates, mixtures thereof and the like. Surface additives may be present in an amount of from about 0.1 to about 10 wt %, from about 0.5 to about 7 wt % of the toner. Examples of such additives include those disclosed in U.S. Pat. Nos. 3,590,000, 3,720,617, 3,655,374 and 3,983,045, the entire disclosure of each of which herein is incorporated by reference in entirety. Other additives include zinc stearate and AEROSIL R972® (Degussa). The coated silicas of U.S. Pat. Nos. 6,190,815 and 6,004,714, the disclosure of each of which herein is incorporated by reference in entirety, also can be present in an amount of from about 0.05 to about 5%, from about 0.1 to about 2% of the toner, which additives can be added during aggregation or blended into the formed toner product.

The characteristics of the toner particles may be determined by any suitable technique and apparatus. Volume average particle diameter, $D_{50v}$, number average particle diameter, $D_{16n}$, $D_{50n}$, $GSD_v$, $GSD_n$ and so on are examples of parameters of characterizing particles and particle populations. Some metrics may be obtained by means of a measuring instrument, such as, a Beckman Coulter MULTISIZER 3, operated as recommended by the manufacturer. Cumulative particle distributions can be used to obtain various population parameters, which can be used to determine or to estimate, for example, median size, amount of coarse particles, amount of fine particles and so on. The relative amount of fine particles can be determined from the $D_{50n}/D_{16n}$ value, which can be less than about 1.25 or lower. The percent of fine particles in the populations can be less than about 3.5% or lower.

The gloss level of a toner may have a gloss, as measured with a Gardner device, of from about 01 gloss units (gu) to about 100 gu.

In embodiments, toners of the present disclosure may be utilized as low melt toners, such as, ultra low melt (ULM) toners. In embodiments, the dry toner particles, exclusive of external surface additives, may have the following characteristics:

(1) circularity of from about 0.9 to about 1 (measured with, for example, a Sysmex 3000), from about 0.95 to about 0.99, from about 0.96 to about 0.98;

(2) $T_g$ of from about 45° C. to about 60° C., from about 48° C. to about 55° C.; and/or (3) melt flow index (MFI) in g/10 min (5 kg/130° C.) of from about 70 to about 170.

Toners may possess favorable charging characteristics when exposed to a variety of relative humidity (RH) conditions. Styrene/acrylate resin in the core can provide improved charging of the toner particle under plural environmental conditions as compared to an analogous toner but containing only polyester in the core. Presence of a styrene/acrylate resin enables tuning or altering the composition to obtain a more robust toner particle that is optimized under plural environmental conditions, as revealed by testing and optimized performance in more than one zone, such as, A and B zones. The styrene/acrylate resin(s) also lessen or diminish less desirable properties of polyester-only toner.

D) Developers

The toner particles thus formed may be formulated into a developer composition. For example, the toner particles ma be mixed with carrier particles to achieve a two component developer composition. The toner concentration in the developer may be from about 1% to about 25% by weight of the total weight of the developer with the remainder of the developer composition being the carrier. However, different toner and carrier percentages may be used to achieve a developer composition with desired characteristics.

a) Carriers

Examples of carrier particles for mixing with the toner particles include those particles that are capable of triboelectrically obtaining a charge of polarity opposite to that of the toner particles. Illustrative examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326.

In embodiments, the carrier particles may include a core with a coating thereover, which may be formed from a polymer or a mixture of polymers that are not in close proximity thereto in the triboelectric series, such as, those as taught herein, such as, a hybrid of interest, or as known in the art. The coating may include fluoropolymers, terpolymers of styrene, silanes and the like. The coating may have a coating weight of for example, from about 0.1 to about 10% by weight of the carrier.

Various effective suitable means can be used to apply the polymer to the surface of the carrier core, for example, cascade roll mixing, tumbling, milling, shaking, electrostatic powder cloud spraying, fluidized bed mixing, electrostatic disc processing, electrostatic curtain processing, combinations thereof and the like. The mixture of carrier core particles and polymer then may be heated to enable the polymer to melt and to fuse to the carrier core. The coated carrier particles then may be cooled and thereafter classified to a desired particle size.

E) Imaging and Manufacturing Devices

The toners may be used for electrostatographic or electrophotographic processes, including those disclosed in U.S. Pat. No. 4,295,990, the entire disclosure of which herein is incorporated by reference in entirety. In embodiments, any known type of image development system may be used in an image developing device, including, for example, magnetic brush development, jumping single component development, hybrid scavengeless development (HSD), 3D printers (including those disclosed in U.S. Pat. Nos. 5,204,055; 7,215,442; and 8,289,352) or any other type of priming apparatus that is capable of applying and fusing a toner on a substrate or to form an article of manufacture. Those and similar development systems are within the purview of those skilled in the art.

Color printers commonly use one to four, or more housings carrying different colors to generate full color images based on black plus the standard printing colors, cyan, magenta and yellow. However, in embodiments, additional housings may be desirable, including image generating devices possessing five housings, six housings or more, thereby providing the ability to carry additional toner colors to print an extended range of colors (extended gamut) and to provide a clear coat or coating.

Thermoplastic and thermosetting styrene and acrylate polymers can be used for 3-D printing by any of a variety of materials and methods, such as, selective heat sintering, selective laser sintering, fused deposition modeling, robocasting and so on. The resin can be formed into sheets for use in laminated object manufacturing. In embodiments, the resin is configured as a filament. Granular resin can be used in selective laser melting methods. Ink jet devices can deliver resin.

Examples of polymers for such uses include acrylonitrile butadiene styrene, polyethylene, polymethylmethacrylate, polystyrene and so on. In embodiments, the polymers can be mixed with an adhesive to promote binding. In embodiments, an adhesive is interleaved with a layer of cured or hardened polymer to bind leafs or layers.

A polymer may be configured to contain a compound that on exposure to a stimulant decomposes and forms one or more free radicals, which promote polymerization of a polymer of interest, such as, forming branches, networks and covalent bonds. For example, a polymer can comprise a photoinitiator to induce curing on exposure to white light, an LED UV light and so on. Such materials can be used in stereolithography, digital light processing, continuous liquid interface production and so on.

Waxes and other curing material can be incorporated into a 3-D composition or can be provided as a separate composition for deposition on a layer of a resin of interest or between layers of a resin of interest.

For example, a selective laser sintering powder, such as, a polyacrylate or polystyrene, is placed in a reservoir atop of a delivery piston. Granular resin is transferred from the reservoir to a second void comprising a fabrication piston which carries the transferred resin in the form of a thin layer. The thin layer is then exposed to a light or a laser tuned to melt and to fuse selected sites of the layer of resin particles. A second layer of resin granules is added from the reservoir to the fabrication void and the laser again melts and fuses selected portions of the layer of granules. The heating and fusion is of an intensity and strength to enable heating and fusing of sites from the second layer to sites of the first layer, thereby forming a growing solid structure in the vertical direction. In embodiments, an adhesive is applied to the fused first layer before the unfused granular resin for the second layer is applied. When completed, the unfused resin powder is removed leaving the fused granules in the form of a designed structure. Such a manufacturing method is an additive process as successive layers of the structure are laid down consecutively.

F) Methods for Forming Images

In embodiments are provided methods for forming an antibacterial printed image comprising applying the present toner to a surface.

In embodiments the surface is 2-D (e.g., paper or a label) or 3-D (medical device, such as, a catheter or thermometer). In embodiments, the antibacterial printed image is a clear coat formed with a clear toner (colorless) and applied over a surface to provide an antimicrobial coating on the surface. The clear coat may be applied over an earlier printed or flat image or may be applied as a coating to a 3-dimensional surface, such as, a medical instrument. In embodiments, the antimicrobial printed image is formed with a color toner to provide an antimicrobial image, such as, a label or UPC code. The color antimicrobial printed image may be a printed code, a printed text, or a printed logo.

The toner may be applied to a surface by fusing at a temperature that adheres the toner to the surface, but does not diminish or destroy the antimicrobial properties of the toner, see Example 5. In embodiments, the toner is fused at a temperature from about 80° C. to about 130° C., less than about 125° C., less than about 120° C. less than about 115° C., or lower.

In embodiments, the toner is one which is amenable to fusing without elevated temperatures, a cold fusing process, that can rely on pressure alone, for example, to fuse toner to a surface or to a substrate.

In embodiments, the surface is selected from a paper, a plastic, a textile, a ceramic, a metal, a rock and so on. The antimicrobial printed image, color or clear coat, may be affixed to a menu, a medical device, medical equipment, food packaging, cosmetic packaging, cosmetic products, food preparation products, kitchen products, heating or cooling ductwork, building materials, insulation products, or clean room surfaces.

The following Examples are submitted to illustrate embodiments of the disclosure. The Examples are intended to be illustrative only and are not intended to limit the scope of the disclosure. Also, parts and percentages are by weight unless otherwise indicated. As used herein, "RT," refers to a temperature of from about 20° C. to about 30° C.

EXAMPLES

Example 1: Synthesis of Ag Nanoparticles (AgNP's) by Trisodium Citrate Reduction In a 250 mL beaker were added 100 mL of deionized water (DIW) and 16.988 g of $AgNO_3$ (equivalent to 1 M silver nitrate solution.) The solution was brought to a boil on a hot plate while stirred with a magnetic stir bar at 350 rpm. Once the solution was boiling, 5 mL of a 0.3 M solution of trisodium citrate dehydrate were added dropwise at about 1 drop per second. The beaker then was covered with a watch glass and boiled for an additional 15 min when the solution turned a light golden color. The solution then was taken off the hot plate, cooled to ambient temperature. Turkevich et al. (Disc. Farad. Soc. 11:55-75, 1951) and the precipitate collected.

Example 2: Synthesis of Emulsion Aggregation High Gloss (EA-HG) Toner with Silver Nanoparticles in the Shell A clear (non-pigmented) EA styrene-acrylate toner was prepared at the 2 L bench scale (155 g dry theoretical toner.)

In a 2 L glass reactor, 345.1 g of a latex emulsion comprised of polymer particles generated from emulsion polymerization of styrene, butyl acrylate and β-CEA (41% solids) were added to about 571 g of DIW and the slurry then was homogenized using an IKA ULTRA TURRAX T50 homogenizer operating at about 3,000-4,000 rpm. During homogenization, about 28 g of a flocculent mixture containing about 2.8 g polyaluminum chloride and about 25.2 g of 0.02 M nitric acid were added to the slurry. Thereafter, the 2 L glass reactor was transferred to a heating mantle; the rpm was set to 250 and the mixture was heated to about 50° C. with samples taken periodically to determine the average toner particle size of the growing particles. Once the particle size was about 4.8 μm (COULTER COUNTER), 16.80 g of AgNP's from Example 1 were added to the reactor over 5 min. The reactor then was heated to 52° C. When the toner particle size reached 5.6-6 μm, freezing began with the pH of the slurry being adjusted to 4.5 using 21 g of a 4% NaOH solution and the reactor rpm was decreased to 190. The reactor temperature then was ramped to 96° C. and the slurry was coalesced for 88 min until particle circularity was between 0.92-0.94, as measured by a Flow Particle Image Analysis (FPIA) instrument. The slurry then was cooled and the pH was adjusted to 3.24 with 9.8 g of 0.3M nitric acid. The final particle size was 6.15 μm, $GSD_v$ was 1.25, $GSD_n$ was 1.37 and circularity was 0.920. The total amount of silver present in the toner as analyzed by ICP-MS was 12636 ppm or 1.26%.

Example 3: Preparation of Comparative Toner with No Silver Nanoparticles in the Shell In a 2 L glass reactor, 209 g of the latex emulsion of Example 2, 58 g of aqueous paraffin wax dispersion (30% solids), 58 g of Nipex-35 (17.5% solids) and 10 g of Sun PB15-3 (16% solids) are added to about 470 g of DIW. The slurry is homogenized and aggregated as in Example 2 until particles of about 4.8 μm are obtained. Then, 106 g of an amorphous latex emulsion (41% solids) similar to that in the core were added to the reactor over 5 min. Freezing was as in Example 2 but additionally, 3.74 g of a chelating agent (Versene 100) and more NaOH solution to attain a pH of 4.5 were added. Coalescence is as in Example 2. The final particle size was 5.71 μm, $GSD_v$ was 1.21, $GSD_n$ was 1.25 and circularity was 0.961.

Example 4: Preparation of Wet Deposition Toner Samples to Mimic Toner Transfer A suspension of experimental toner from Example 2 (or the control toner from Example 3) was prepared in DIW containing a small amount of Triton X-100 surfactant. An amount of the suspension corresponding to 9.62 mg of toner particles was suction filtered onto a substrate (nitrocellulose (NC) membrane; a glass microfiber patch; a polyethersulfone (PES) membrane; or filter paper) with an exposed surface area of 9.62 $cm^2$, followed by overnight drying. The membrane pieces containing toner then were placed onto a bacterial lawn obtained from human skin. The bacteria were obtained by direct contact of a finger with an agar plate followed by 24 hr incubation at 37° C. The colonies were picked and the control and experimental agar plates inoculated by streaking the picked colonies. The inoculated petri dish plus toner swatch (toner filtered on the substrate) was incubated at 37° C. for 72 hr.

After 72 hr, the control dish showed a dense lawn of bacterial growth. In all experimental toner samples, the toner inhibited growth of the bacteria by at least 2 to 5 mm around the toner swatch (zone of inhibition, a halo), as well as inhibiting growth of bacteria on the swatch.

TABLE 1

Results of 72 hour incubation of toner swatch on bacterial lawn

| Sample | Results | Observation |
|---|---|---|
| Control | Growth | Dense lawn of bacteria |
| NC | Zone of inhibition | Dense lawn with distinct, even halo and no growth on NC membrane |
| Glass microfiber | Zone of inhibition | Dense lawn with distinct, even halo and no growth on glass microfiber |
| PES | Zone of inhibition | Less dense lawn with distinct, halo and no growth on PES membrane |
| Filter paper | Zone of inhibition | Dense lawn with distinct, uneven halo and no growth on filter paper |

Example 5: Preparation of Wet Deposition Toner Samples to Mimic Toner Fusing

Experimental and control toner were prepared in water containing a small amount of Triton X-100 surfactant. An amount of the suspension corresponding to 9.62 mg of toner particles was passed through an NC piece with an exposed surface area of 9.62 $cm^2$. The retained particles and NC membrane pieces were dried at RT, then enveloped in Mylar film and passed through a GBC (Illinois) laminator set to 136° C. or 120° C. to mimic fusing temperature during image formation with toner.

Both the experimental and control toner, "fused," on the NC were placed in lawned petri dishes and incubated for three months. Bacterial growth and some degradation on the swatch (revealed as a bubbling appearance of the toner) were observed on the NC with the control toner while the experimental toner NC sample showed no bacteria growth. Even though no halo is evident after fusing at 136° C., the silver-containing toner in the swatch is free from bacterial growth. A halo was observed with the swatches laminated at 120° C. The toner comprising AgNP's in the shell clearly inhibits microbial growth of, in and about the toner transferred and fused to a substrate.

It will be appreciated that various of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

All references cited herein are herein incorporated by reference in entirety.

We claim:

1. An antimicrobial toner particle comprising a core and shell, wherein the shell consists of metal ion nanoparticles comprising silver, the metal ion nanoparticles having an average diameter of about 1 nm to about 10 nm, with an average particle size standard deviation of from about 1 nm to about 3 nm.

2. The toner particle of claim 1, wherein said core comprises a polystyrene/acrylate resin.

3. The toner particle of claim 1, wherein said core comprises a polymer selected from the group consisting of styrene acrylates, styrene butadienes, styrene methacrylates and combinations thereof.

4. The toner particle of claim 1, wherein said core comprises a resin selected from the group consisting of poly(styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid) and combinations thereof.

5. The toner particle of claim 1, wherein said core resin comprises styrene, butyl acrylate and β-carboxy ethyl acrylate.

6. The toner particle of claim 1, wherein said core comprises a polyester resin.

7. The toner particle of claim 1, comprising a colorant.

8. The toner particle of claim 1, wherein the metal ion nanoparticle is present in the toner particle from about 12,000 to about 15,000 ppm of the toner.

9. A substrate or a surface comprising the toner particle of claim 1.

10. The substrate or surface of claim 9, wherein said toner particles comprise an image.

11. The substrate or surface of claim 9, wherein said substrate comprises a paper.

12. The substrate or surface of claim 9, comprising more than one color.

13. The substrate or surface of claim 9 which is two dimensional.

14. The substrate or surface of claim 9 comprising a three dimensional structure.

15. The substrate or surface of claim 9, wherein said toner particles comprise a coating.

16. The substrate or surface of claim 9, comprising a paper, a plastic, a textile, a ceramic, a wood, a rock or a metal.

17. The substrate or surface of claim 9, comprising a printed code, a printed text or a printed logo.

18. The substrate or surface of claim 9, comprising a menu, a medical device, a medical equipment, a food package, a food packaging, a cosmetic package, a cosmetic packaging, a cosmetic, a food preparation product, a kitchen product, heating or cooling ductwork, a building material, an insulation product or a clean room surface.

19. The substrate or surface of claim 9, which is exposed to ambient conditions.

20. The toner particle of claim 1, wherein the metal ion nanoparticles comprise a silver composite.

* * * * *